US006246164B1

(12) United States Patent
Heyman et al.

(10) Patent No.: US 6,246,164 B1
(45) Date of Patent: Jun. 12, 2001

(54) COLOR PICTURE TUBE HAVING A LOW EXPANSION TENSION MASK ATTACHED TO A HIGHER EXPANSION FRAME

(75) Inventors: Philip Michael Heyman, Robbinsville; Richard William Nosker, Princeton; Joey John Michalchuk, Lambertville, all of NJ (US); Istvan Gorog, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/283,447

(22) Filed: Apr. 1, 1999

(51) Int. Cl.[7] ..... H01J 29/80
(52) U.S. Cl. ..... 313/407
(58) Field of Search ..... 313/402, 407, 313/404, 405

(56) References Cited

U.S. PATENT DOCUMENTS

| | | | | |
|---|---|---|---|---|
| 3,638,063 | | 1/1972 | Tachikawa et al. | 313/348 |
| 4,748,370 | | 5/1988 | van den Broek | 313/404 |
| 5,647,653 | * | 7/1997 | Cherukuri | 313/402 |
| 5,850,121 | * | 12/1998 | Matsudate | 313/402 |
| 6,043,597 | * | 3/2000 | Fichtler et al. | 313/402 |
| 6,084,342 | * | 7/2000 | Ragland, Jr. | 313/402 |
| 6,104,132 | * | 8/2000 | Nose et al. | 313/402 |

* cited by examiner

*Primary Examiner*—Nimeshkumar D. Patel
*Assistant Examiner*—Todd Reed Hopper
(74) *Attorney, Agent, or Firm*—Joseph S. Tripoli; Dennis H. Irlbeck

(57) ABSTRACT

A color picture tube has a tensioned mask supported by a support frame mounted within said tube. The mask has a significantly lower coeffiecient of thermal expansion than the frame. Intermediary members are located between the mask and the frame. The intermediary members are of a material similar to that of the mask. Each of the members is attached to the frame at a single location and the mask is attached to edges of the intermediary members. Further included are guides for holding the intermediary members to the frame while permitting expansion of the frame relative to the intermediary members.

5 Claims, 3 Drawing Sheets

COLOR PICTURE TUBE HAVING A LOW EXPANSION TENSION MASK ATTACHED TO A HIGHER EXPANSION FRAME

This invention relates to color picture tubes having tension masks, and particularly to a tube having means for connecting a tension mask, that is made of a material having a relatively low coefficient of thermal expansion material, to a support frame, that has a significantly higher coefficient of thermal expansion.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material would require a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is relatively costly to make both the mask and frame out of identical or similar low expansion materials. Therefore, it is desirable to use the combination of a low expansion tension mask with a higher expansion support frame, and to provide a solution to the problem that exists when there is a substantial mismatch in coefficients of thermal expansion between a tension mask and its support frame.

SUMMARY OF THE INVENTION

The present invention provides an improvement in a color picture tube having a tensioned mask supported by a support frame mounted within the tube. The mask has a significantly lower coeffiecient of thermal expansion than the frame. Intermediary members are located between the mask and the frame. The intermediate members are of a material similar to that of the mask. Each of the intermediate members is attached to the frame at a single location, and the mask is attached to edges of the intermediate members. Further included are guides for holding the intermediate members to the frame, while permitting expansion of the frame relative to the intermediary members.

DETAILED DESCRIPTION OF THE PREFERRED EMBODIMENTS

Figure 1:
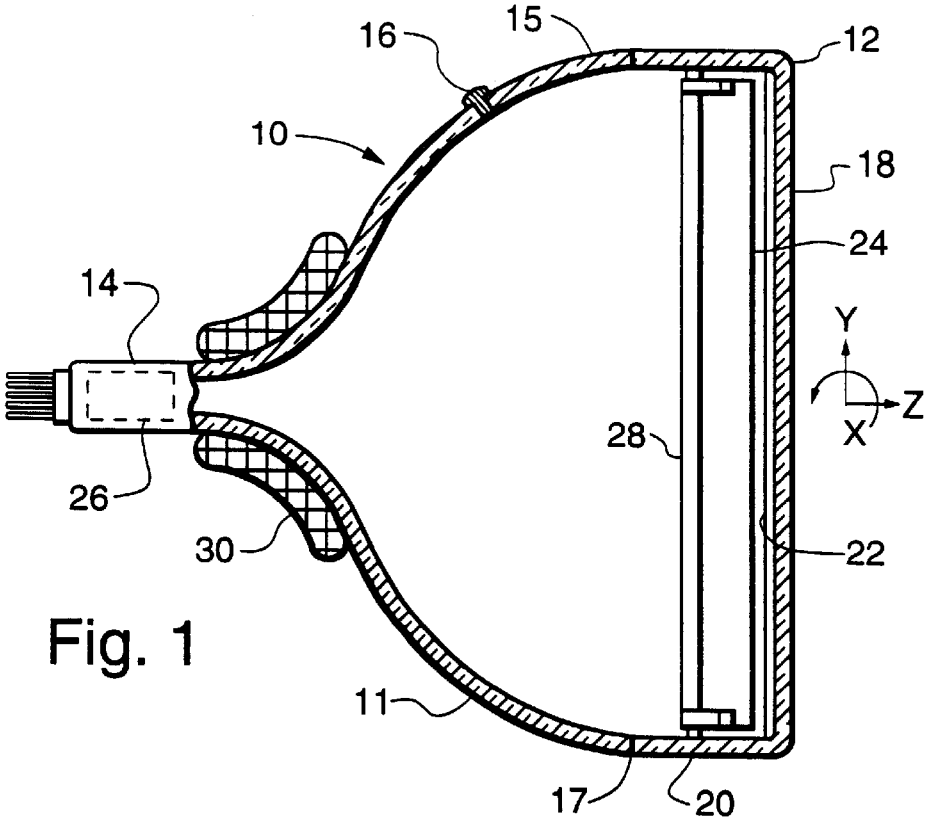
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
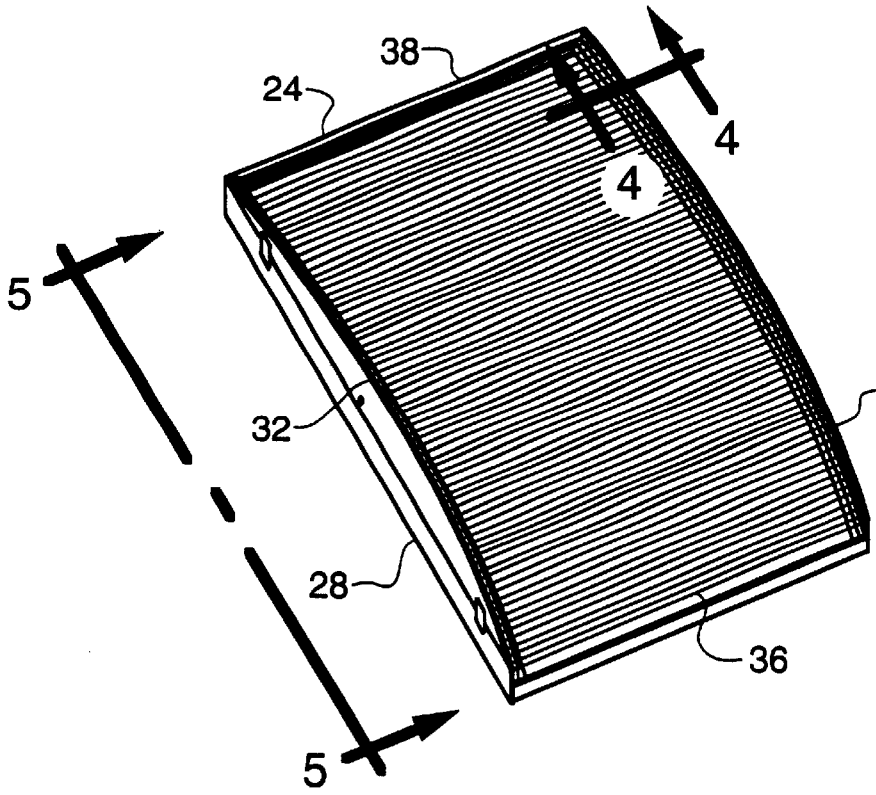
FIG. 2 is a perspective view of a tension mask-frame assembly.
Figure 3:
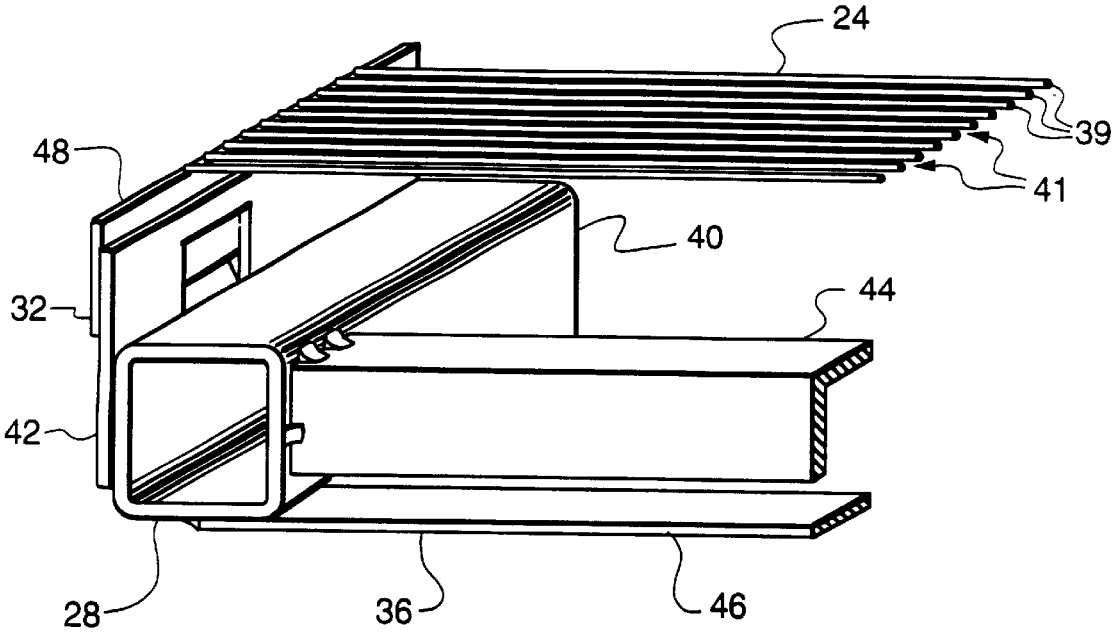
FIG. 3 is a partial perspective view of the mask-frame assembly of FIG. 2.

The tension mask 24, as shown in FIGS. 2 and 3, is attached to a peripheral frame 28 that includes two long sides 32 and 34, and two short sides 36 and 38. The two long sides 32 and 34 of the frame parallel a central major axis, X, of the tube; and the two short sides 36 and 38 parallel a central minor axis, Y, of the tube. The tension mask 24 includes an apertured portion that contains a plurality of metal strips 39 having a multiplicity of elongated slits 41 therebetween that parallel the minor axis of the mask. Each slit 41 extends between the two long sides 32 and 34 of the mask 24.

As shown in greater detail in FIG. 3, each of the two long sides 32 and 34 (not shown) of the frame 28 includes a rigid section 40 and a compliant section 42 cantilevered from the rigid section. The rigid sections 40 are hollow tubes, and the compliant sections 42 are metal plates. The compliant sections 42 may vary in height from the center of each section longitudinally to the ends of the sections to permit the best tension compliance over the mask. Each of the short sides 36 and 38 (not shown) has an L-shaped cross-section upper portion 44 parallel to and separated from a flat bar-shaped lower portion 46.

Figure 4:
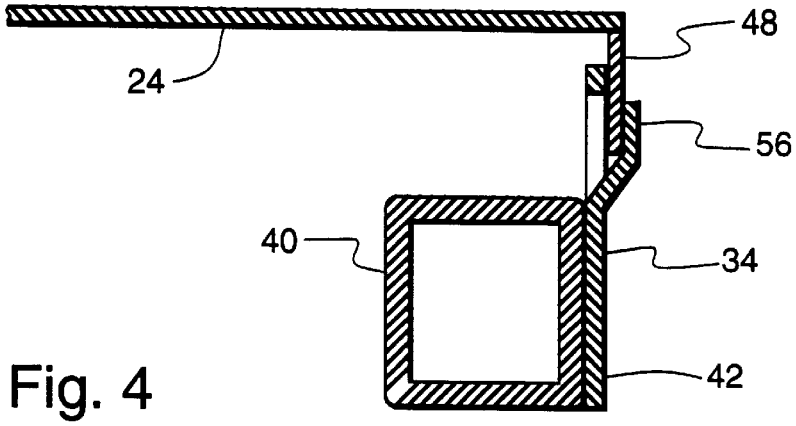
FIG. 4 is a cross-sectional view of the mask-frame assembly taken at line 4—4 of FIG. 2.
Figure 5:
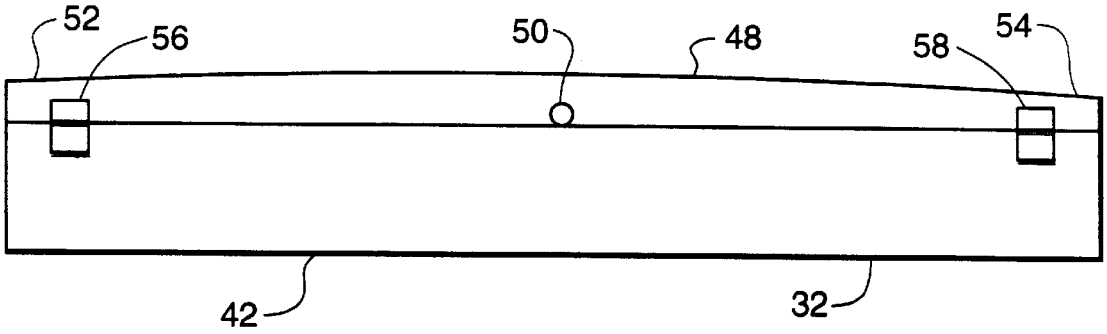
FIG. 5 is a front view of the mask-frame assembly taken at line 5—5 of FIG. 2.

Attached to each compliant section 42 is a intermediary member 48, as shown in FIGS. 3, 4 and 5. Each intermediary member 48 extends the length of a long side, 32 and 34, and overlaps a compliant section 42. The intermediary members 48 are welded to the compliant sections at a single central location 50. The intermediary members 48 are of a material that has a coefficient of thermal expansion similar to that of the mask 24. Therefore, changes of temperature will have little effect on the position of the mask 24 relative to the intermediary members 48. The two ends, 52 and 54 of the intermediary members 48 are held to the compliant sections 42 by two clips, 56 and 58, respectively, that extend outwardly from the compliant section 42. The clips 56 and 58 serve as guides that hold the intermediary member 48 to prevent rotation of the member around its weld location 50, while permitting longitudinal movement of the compliant section 42, caused by its greater expansion during tube operation, relative to the intermediary member 48. The clips 56 and 58 either may be formed by cutouts in the frame, as shown in FIGS. 3, 4 and 5, or may be separate parts (not shown) that are welded to the frame. The two long sides of the tension mask 24 are welded to the upper distal edges of the two parallel intermediary members 48.

In one preferred embodiment, the rigid sections 40 of the long side members 32 and 34 are hollow square tubes of 4130 steel having a wall thickness of 0.175 cm. The thicknesses of the compliant sections 42 and intermediary members 48 are determined by considering mask thickness, the flexibility of the total mask-frame assembly and the desired warp misregistration limits. In a further preferred embodiment, the compliant sections 42 are plates of 4130 stainless steel that are 0.157 cm thick. The two L-shaped upper portions 44 are preferably of CRS-1018 steel having a thickness of 0.318 cm. The two bar-shaped lower portions 46 are preferably of 300 Series stainless steel, which has a different coefficient of thermal expansion than does the CRS-1018 steel of the upper portions 44. When the frame 28 is heated, the lower portions 46 expand more than do the upper portions 44. The differential expansion between the lower portions 46 and the upper portions 44 relieves stress in the compliant sections 42 and intermediary members 48, while also reducing tension in the mask 24 during high temperature processing. The tension mask 24 and intermediary members 48, preferably, are all constructed out of Invar or similar material that has a relatively low coefficient of thermal expansion. In one embodiment the mask 24 is 0.1 mm (4 mils) thick and the intermediary member 48 is 0.3 cm thick.

Although the rigid sections 40 have been shown as hollow square tubes, other preferred configurations, such as those having L-shaped, C-shaped or triangular-shaped cross-sections, are also possible for these sections. Furthermore, although the short sides 36 and 38 of the frame 28 have been shown as having L-shaped cross-sections, other preferred configurations may be used, such as C-shaped, triangular shaped or box-shaped.

What is claimed is:

1. A color picture tube having a tension mask supported by a support frame mounted within said tube, comprising said mask having a significantly lower coeffiecient of thermal expansion than said frame, intermediary members located between said mask and said frame, said members being of a material similar to that of said mask, each of said members being attached to said frame at a single central location and said mask being attached to edges of said intermediary members, and guides for holding said intermediary members to said frame to permit expansion of said frame relative to said intermediary members.

2. The color picture tube as defined in claim 1, wherein said guides are clips that are formed in said frame.

3. The color picture tube as defined in claim 1, wherein said guides are clips that are welded to said frame.

4. The color picture tube as defined in claim 1, wherein said mask is made from Invar and said frame is made from steel.

5. The color picture tube as defined in claim 4, wherein said intermediary members are made from Invar.

* * * * *